US007284688B1

(12) United States Patent
Barsness

(10) Patent No.: US 7,284,688 B1
(45) Date of Patent: Oct. 23, 2007

(54) BOX CLOSURE WITH HINGED TAB

(76) Inventor: John G. Barsness, 2121 Van Hise Ave., Madison, WI (US) 53727

( * ) Notice: Subject to any disclaimer, the term of this patent is extended or adjusted under 35 U.S.C. 154(b) by 0 days.

(21) Appl. No.: 11/612,302

(22) Filed: Dec. 18, 2006

(51) Int. Cl.
*B65D 43/22* (2006.01)

(52) U.S. Cl. ..... 229/125.39; 24/545

(58) Field of Classification Search ..... 229/125.37, 229/125.39; 24/545, 557, 565, 568; 292/288
See application file for complete search history.

(56) References Cited

U.S. PATENT DOCUMENTS 1,076,897 A * 10/1913 Lettre ..... 229/125.39
1,106,069 A 8/1914 Anderson
1,934,974 A * 11/1933 Grand ..... 229/125.39
2,536,941 A * 1/1951 Jones ..... 292/288
2,828,905 A * 4/1958 Frizzell ..... 229/125.39
2,879,097 A * 3/1959 Hendee ..... 229/125.41
3,221,977 A 12/1965 Pollert
3,276,663 A 10/1966 Falconer
3,545,801 A 12/1970 Barsness
4,019,764 A * 4/1977 Okamura ..... 292/288
4,021,890 A * 5/1977 Kurosaki ..... 24/371
4,206,869 A 6/1980 Gurevitz
4,761,935 A * 8/1988 King et al. ..... 229/125.39
6,230,965 B1 * 5/2001 Dismukes ..... 229/125.39
6,290,126 B1 9/2001 Zudal
6,571,538 B2 * 6/2003 Luby ..... 292/288

* cited by examiner

*Primary Examiner*—Gary E Elkins
(74) *Attorney, Agent, or Firm*—Stiennon & Stiennon

(57) ABSTRACT

A box closure device releasably engages the flaps of a box in a closed configuration. The device has a lower element which extends generally in a first plane. An upper element is connected to the lower element and spaced substantially parallel to it by a central stem, such that portions of the box flaps are engaged between the upper and the lower element. A tab is connected to the upper element along a living hinge and is pivotable about the hinge from a first position extending substantially in the same plane as the upper element, to a second position which extends upwardly from the upper element, such that the tab may be engaged to assist in the rotation of the device when being installed in a box, and, when released, the tab returns to the first position. The lower element may be a planar disc, or may be cupped.

10 Claims, 2 Drawing Sheets

BOX CLOSURE WITH HINGED TAB

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for releasably closing cartons and boxes.

The conventional corrugated cardboard carton or box typically has four top flaps, one extending from each of four side walls. The outer top flaps overlie the inner top flaps, forming a double thickness of corrugated material. An effective closure or seal can be ensured by applying strapping tape, staples, or the like. The carton may also be closed by interleaving the top flaps one with other, although this method of closure will tend to distort the box flaps and is not always satisfactory. In my U.S. Pat. No. 3,545,801, entitled "Box Closure Fastening", the disclosure of which is incorporated by reference herein, I disclosed a molded plastic box closure which had a half-disc-shaped upper member connected by a stem to a lower disc. The stem spaced the upper member from the lower disc such that the four box flaps could be received between the upper and lower members, thereby holding the box closed. The half-disc-shaped upper member allowed the closure to be rotated in 90 degree increments to stepwise engage each of the four flaps. This device provided a convenient reusable closure for cartons, and further disclosed a rigid protruding carrying handle, which aided in carrying of the box and the rotating of the device into engagement with the box flaps.

Although an upwardly protruding handle provides leverage in rotating the device, the vertical protrusion can interfere with stable stacking of multiple closed cartons, yet without such a handle, the narrow discs can be challenging to conveniently install and manipulate. What is needed is a low-profile, user-friendly, and conveniently installable box closure which will not interfere with or preclude the stacking of one closed box upon another yet will also provide, if desired, a handle to carry the closed box.

SUMMARY OF THE INVENTION

The box closure device of this invention facilitates the fast and certain installation and easily releasable engagement of the flaps of a box in a closed configuration. The device has a lower element which extends generally in a first plane. An upper element is connected to the lower element and spaced substantially parallel to it by a central stem, such that portions of the box flaps' upper and lower surfaces are engaged between the upper element and the lower element. The upper element may be smaller in area than the lower element. A tab is connected to the upper element along a living hinge and is pivotable about the hinge from a first position extending substantially in the same plane as the upper element, to a second position which extends upwardly from the upper element, such that the tab may be gripped and used to assist in the installation and rotation of the device in a box, and, when released, the tab returns to the first position. The tab may be somewhat less than one half the area of the remainder of the upper element, and the hinge is located approximately along the forward edge of the stem. The lower element may be a planar disc, or may be cupped and connected to the stem in a snap engagement.

It is an object of the present invention to provide a box closure device which is easily manipulated and speedily installed to close the flaps of a box, as well as being speedily rotated to free the box flaps for opening the box, yet does not interfere with the stacking of one closed box upon another.

It is another object of the present invention to provide a box closure device which is easily and securely gripped when being installed, but which has a low profile once installed.

It is a further object of the present invention to provide, if desired, a box closure device which can be secured in place to connect the flaps of a closed box.

Further objects, features and advantages of the invention will be apparent from the following detailed description when taken in conjunction with the accompanying drawings.

DESCRIPTION OF THE PREFERRED EMBODIMENTS

Figure 1:
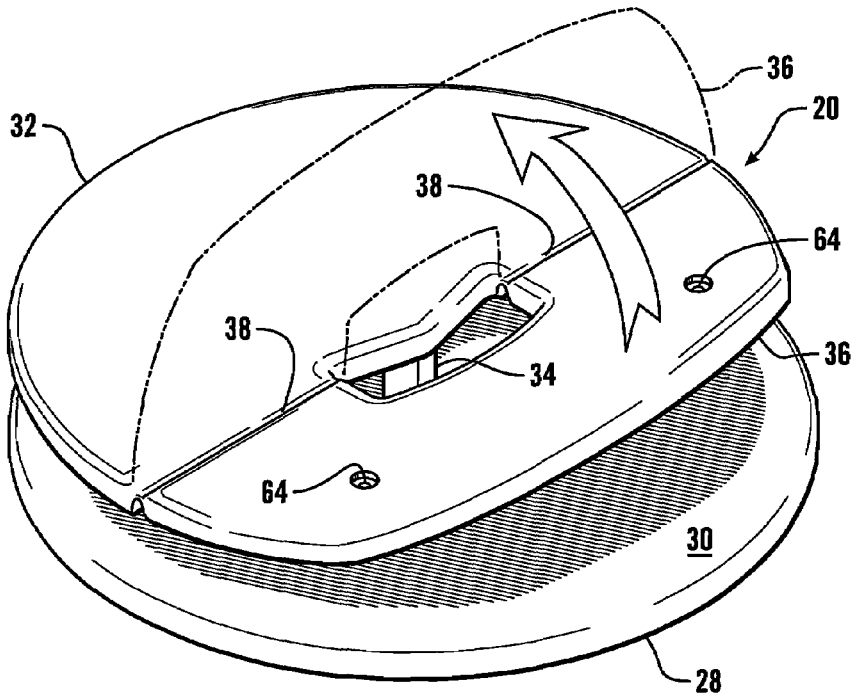
FIG. 1 is an isometric view of the box closure device of this invention.
Figure 2:
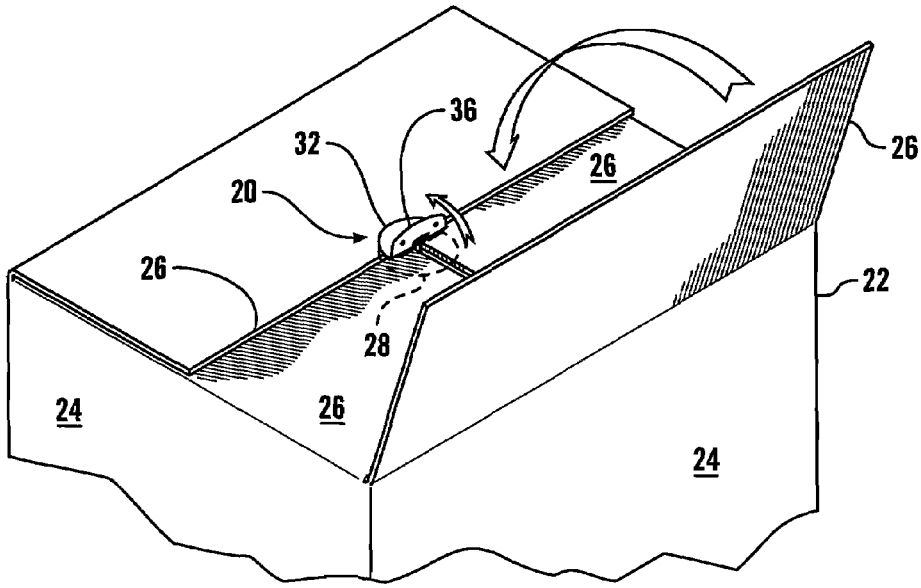
FIG. 2 is an isometric view of the device of FIG. 1 being installed in box.
Figure 3:
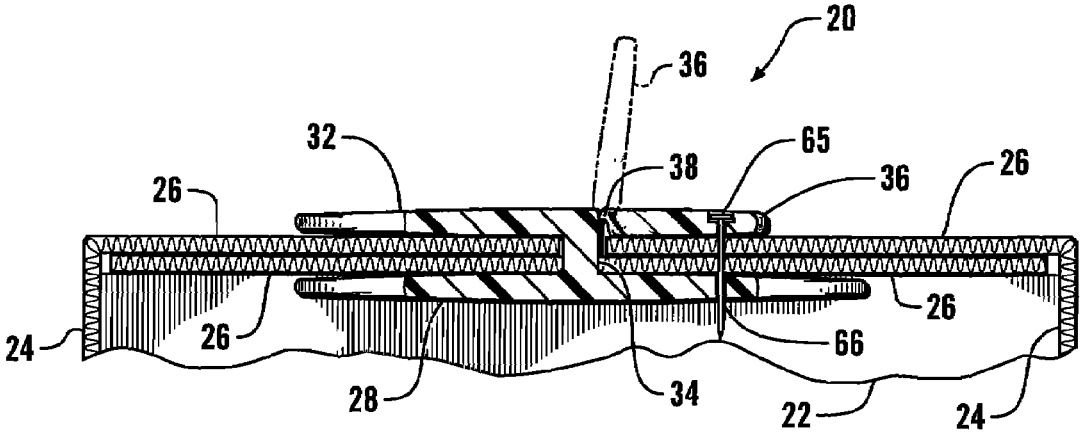
FIG. 3 is a cross-sectional view of the device of FIG. 2 shown in place closing the box.

Referring more particularly to FIGS. 1-4 wherein like numbers refer to similar parts, a box closure device 20 is shown in FIGS. 1-3 for releasably closing the flaps of a corrugated carton or box 22, shown in FIG. 2. The conventional box 22 has four side walls 24, with a separate flap 26 extending from each side wall. Each flap 26 is typically one half the width of the box opening, so that all four flaps meet at approximately the center of the box opening. Two flaps 26 are thus overlain by the other two flaps of the four.

The device is preferably formed as an injection molded plastic part. As shown in FIG. 1, the device 20 has a lower element 28 with an upper surface 30 extending generally in a first plane. The lower element 28 may be generally disc shaped, or may have some other perimeter shape as desired. As shown in FIG. 3, the lower element is connected to an upper element 32 by a narrow cylindrical stem 34. The stem 34 spaces the upper element from the lower element in a generally parallel arrangement, such that when the device is installed in a box, the two thicknesses of the overlain box flaps 26 are engaged between the upper element and the lower element. It will be observed that the upper element 32 is smaller than the lower element 28, and may be roughly semicircular in shape.

As shown in FIG. 1, a tab 36 is connected to the upper element 32 by a hinge 38 which may be comprised of two living hinges spaced on either side of the stem 34. The tab 36 may thus be generally U-shaped. The living hinge 38 may be formed in any conventional fashion, for example as a region of greatly reduced thickness in an injection molding. The hinge 38 allows the tab 36 to extend in substantially the same plane as the upper element 32 at most times, and does not protrude any more above the box flaps than does the upper element itself. However, in the course of installing the device 20 in a box 22, the user grips the projecting tab 36 and pivots it upwardly. This upward pivot performs two functions. First, it reveals the underlying lower element 28 and allows the box flaps 26 to be placed over the lower element, and second it provides a convenient grip on the device 20 to allow the user to apply force to the element and urge it into engagement with the corrugated cardboard of the box flaps. It should be noted that this engagement between the box flaps and the device may involve some squeezing distortion of the cardboard of the box flaps, and thus it is helpful to have a secure grip on the device 20 as it is being installed if the thickness of the corrugated cardboard flaps requires.

The installation of the device 20 into the opening of a box 22 involves first engaging one lower box flap 26 between the upper element 32 and the lower element 28, then lowering the other lower box flap 26 onto the lower element while gripping the element by the tab 36 and thus keeping the tab from interfering with the placement of the second lower flap. Next one of the upper flaps is folded down and engaged between the upper and lower elements of the device, as shown in FIG. 2, and finally the last upper flap is folded down into position overlying the lower element 28 and the overlying lower flaps. The device 20 is then rotated 90 degrees from the position shown in FIG. 2 to secure the box 22 in a closed configuration. Once the user releases the device tab 36, it returns to a position substantially in the same plane as the upper element 32. The tab 36 is particularly helpful where the corrugated cardboard of the box is particularly thick, and must be squeezed or crushed by the rotation of the device 20. To remove the closure, and thus open the box, the above steps are repeated in reverse.

As best shown in FIG. 3, the upper element 32 and the lower element 28 are preferably formed with a taper such that each element is thicker at the stem, and then tapers as it extends radially outwardly from the stem. Such a taper aids insertion of the flaps into the device. Moreover, the tapered upper element 32 assists the user in sliding a second box over the top of a first box closed with the device 20, by reducing the overall height of the device 20 as it is approached by another box which is being slid into engagement.

To assist in retaining the closure 20 in position, and preventing the rotation thereof, the hinged tab 44 may be provided with one or more countersunk fastener openings 64, through which a conventional nail or pin may be inserted. The lower element 28 is preferably provided with an opening 66 immediately beneath each of the tab openings 64. A fastener such as a pin 65, or a narrow diameter nail may then be extended through the holes 64, 66, penetrating the engaged corrugated cardboard and securely fastening the closure 20 in place. The fastener 65 may have a roughened exterior such as provided by circumferential ridges, to aid in the gripping of the corrugated cardboard material of the flaps. Moreover, the pin connected closure 20 tends to resist the collapse of the box flaps at the center, as it will be noted that three of the four flaps will be directly engaged by the two pins. Alternatively, one or more plastic barbs may be formed integrally with the upper element which may be depressed into engagement with the corrugated cardboard of the box once the closure device is in place.

Figure 4:
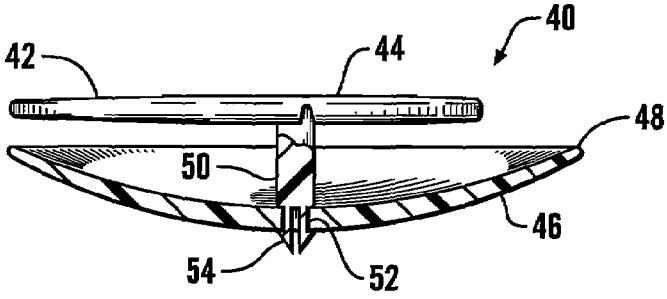
FIG. 4 is a side elevational view, partially cut away in cross-section, of an alternative embodiment box closure device of this invention which is comprised of two parts.

An alternative embodiment box closure device 40 is shown in FIG. 4. The device 40 has an upper element 42 with hinged tab 44 similar to those of the device 20 described above. However, the lower element 46 is a concave shell with an upper rim 48 which extends in a plane generally parallel to the upper element. In order to fabricate this part, the device 40 is preferably formed as two molded components, with the stem 50 formed together with the upper element 42, and the lower element 46 being formed as a dish with a central hole 52. Resilient projecting members or barbs 54 extend from the stem 50 and engage with the lower element in snap engagement.

It should be noted that the device of the present invention may be formed as a single molded piece as shown in FIGS. 1 and 3, in two snap-together pieces as shown in FIG. 4, or may be formed from multiple pieces connected by screw or other fasteners, such as shown in my U.S. Pat. No. 3,545,801.

It should be understood that the device may be formed of any appropriate plastic material such as nylon, or polyester. It may also be fabricated as a composite part formed of resin and reinforcing fibers, preferably in which the reinforcing fibers are arranged to run perpendicular to the hinge line, to thereby reinforce the hinge.

It is understood that the invention is not limited to the particular construction and arrangement of parts herein illustrated and described, but embraces all such modified forms thereof as come within the scope of the following claims.

I claim:

1. A box closure device for releasably engaging multiple flaps of a box in a closed configuration, the device comprising;

a lower element having portions which extend generally in a first plane;

an upper element spaced above the lower element and having portions in fixed parallel relation to the lower element first plane;

a stem which extends between the lower element and the upper element, the upper element being spaced from the lower element to receive portions of the box flaps therebetween, wherein the lower element protrudes to a first side and an opposite side of the stem; and a tab connected to the upper element along a hinge, wherein the tab protrudes to overlie the fixed lower element where it protrudes to the opposite side an unobstructed gap being defined between the tab and the fixed lower element where it protrudes to the opposite side the tab being pivotable about the hinge from a first position extending substantially in the same plane as the upper element, to a second position which extends upwardly from the upper element, permitting the tab to be engaged and used to assist in the rotation of the device when being installed in a box, and, when released, returned to the first position.

2. The device of claim 1 wherein the portions of the lower element which extend generally in the first plane comprise the upper rim of a concave shell.

3. The device of claim 1 wherein the hinge comprises a living hinge.

4. A box closure device for releasably engaging multiple flaps of a box in a closed configuration, the device comprising;

a lower element having portions which extend generally in a first plane;

an upper element spaced above the lower element;

a stem which extends between the lower element and the upper element, the upper element being spaced from the lower element to receive portions of the box flaps therebetween; and a tab connected to the upper element along a hinge the tab being pivotable about the hinge from a first position extending substantially in the same plane as the upper element to a second position which extends upwardly from the upper element permitting the tab to be engaged and used to assist in the rotation of the device when being installed in a box and, when released returned to the first position, wherein the device is formed of plastic, and wherein the lower element is connected to the stem by a snap engagement between portions of the lower element and portions of the stem.

5. A box closure device for releasably engaging multiple flaps of a box in a closed configuration, the device comprising;

a lower element having portions which extend generally in a first plane;

an upper element spaced above the lower element;

a stem which extends between the lower element and the upper element, the upper element being spaced from the lower element to receive portions of the box flaps therebetween;

a tab connected to the upper element along a hinge, the tab being pivotable about the hinge from a first position extending substantially in the same plane as the upper element, to a second position which extends upwardly from the upper element, permitting the tab to be engaged and used to assist in the rotation of the device when being installed in a box, and, when released, returned to the first position; and portions of the tab which define at least one first through hole; and portions of the lower element defining at least one second through hole corresponding to the tab through hole, such that a fastener may be extended through said through holes to fix the tab in place.

6. A box closure device for releasably engaging multiple flaps of a box in a closed configuration, the device comprising:

a lower element having portions which extend generally in a first plane;

an upper element spaced above the lower element;

a stem which extends between the lower element and the upper element, the upper element being spaced from the lower element to receive portions of the box flaps therebetween; and a tab connected to the upper element along a hinge, the tab being pivotable about the hinge from a first position extending substantially in the same plane as the upper element, to a second position which extends upwardly from the upper element, permitting the tab to be engaged and used to assist in the rotation of the device when being installed in a box, and, when released, returned to the first position, and wherein the tab is connected to the upper element by two hinges, spaced on either side of the stem.

7. The device of claim 6 wherein the two hinges are living hinges.

8. A molded box closure device for releasably engaging multiple flaps of a box in a closed configuration, the device comprising;

a lower element having portions which extend generally in a first plane;

an upper element spaced above the lower element and having portions in fixed parallel relation to the lower element first plane;

a stem which extends between the lower element and the upper element, the upper element being spaced from the lower element to receive portions of the box flaps therebetween, wherein the lower element protrudes to a first side and an opposite side of the stem; and a tab connected to the upper element along an integral living hinge, wherein the tab protrudes to overlie the fixed lower element where it protrudes to the opposite side of the stem an unobstructed gap being defined between the tab and the fixed lower element where it protrudes to the opposite side, the tab being pivotable about the living hinge from a first position extending substantially in the same plane as the upper element, to a second position which extends upwardly from the upper element, such that the tab may be engaged to assist in the rotation of the device when being installed in a box, and, when released, returned to the first position.

9. A molded box closure device for releasably engaging multiple flaps of a box in a closed configuration, the device comprising;

a lower element having portions which extend generally in a first plane;

an upper element spaced above the lower element;

a stem which extends between the lower element and the upper element, the upper element being spaced from the lower element to receive portions of the box flaps therebetween; and a tab connected to the upper element along an integral living hinge, the tab being pivotable about the living hinge from a first position extending substantially in the same plane as the upper element, to a second position which extends upwardly from the upper element, such that the tab may be engaged to assist in the rotation of the device when being installed in a box, and, when released, returned to the first position, wherein the upper element is formed of resin and reinforcing fibers, the reinforcing fibers being arranged to run perpendicular to the hinge line, to thereby reinforce the hinge.

10. A molded box closure device for releasably engaging multiple flaps of a box in a closed configuration, the device comprising:

a lower element having portions which extend generally in a first plane;

an upper element spaced above the lower element;

a stem which extends between the lower element and the upper element, the upper element being spaced from the lower element to receive portions of the box flaps therebetween;

a tab connected to the upper element along an integral living hinge, the tab being pivotable about the living hinge from a first position extending substantially in the same plane as the upper element to a second position which extends upwardly from the upper element, such that the tab may be engaged to assist in the rotation of the device when being installed in a box, and, when released, returned to the first position;

portions of the tab which define at least one first through hole; and portions of the lower element defining at least one second through hole corresponding to the tab through hole, such that a fastener may be extended through said through holes to fix the tab in place.

* * * * *